US011504599B2

(12) United States Patent
Visser

(10) Patent No.: US 11,504,599 B2
(45) Date of Patent: Nov. 22, 2022

(54) CLAP SKATE

(71) Applicant: SCHAATSENFABRIEK VIKING B.V., Almere (NL)

(72) Inventor: Hiddo Visser, Twello (NL)

(73) Assignee: SCHAATSENFABRIEK VIKING B.V

( * ) Notice: Subject to any disclaimer, the term of this patent is extended or adjusted under 35 U.S.C. 154(b) by 0 days.

(21) Appl. No.: 17/262,372

(22) PCT Filed: Jul. 12, 2019

(86) PCT No.: PCT/NL2019/050441
§ 371 (c)(1),
(2) Date: Jan. 22, 2021

(87) PCT Pub. No.: WO2020/022877
PCT Pub. Date: Jan. 30, 2020

(65) Prior Publication Data

US 2021/0299546 A1 Sep. 30, 2021

(30) Foreign Application Priority Data

Jul. 25, 2018 (NL) ..... N2021395

(51) Int. Cl.
*A63C 1/28* (2006.01)

(52) U.S. Cl.
CPC ..... *A63C 1/28* (2013.01)

(58) Field of Classification Search
CPC ..... A63C 1/28; A63C 3/02
See application file for complete search history.

(56) References Cited

U.S. PATENT DOCUMENTS 3,954,278 A * 5/1976 McLeod ..... A63C 3/12 280/825
6,193,243 B1 2/2001 Johannes Meester et al.
(Continued)

FOREIGN PATENT DOCUMENTS

CN 101795735 A 8/2010
EP 1923104 A1 * 5/2008 ..... A63C 1/28
(Continued)

OTHER PUBLICATIONS

International Search Report and Written Opinion for corresponding International application No. PCT/NL2019/050441 dated Oct. 15, 2019 (11 pages).
(Continued)

*Primary Examiner* — James A Shriver, II
*Assistant Examiner* — Michael T. Walsh
(74) *Attorney, Agent, or Firm* — Mendelsohn Dunleavy, P.C.

(57) ABSTRACT

The invention relates to a clap skate (1) comprising a blade (4) having a rockering, a frame (3), holding the blade (4) in its bottomside and comprising, on its topside, a heel support (5) for the heel portion of a skating shoe (2) or bracket (8) and a forefoot support (6) connected to a front part of a skating shoe (2) or a bracket (8) via a pivot (7). The forefoot support (6) provides a fixed connection to the frame (3), which fixed connection extends in front of the pivot (7) and at the most 5 mm behind the pivot (7).

16 Claims, 1 Drawing Sheet

(56) References Cited

U.S. PATENT DOCUMENTS

| | | | | |
|---|---|---|---|---|
| 6,499,761 | B1 * | 12/2002 | Quellais | A63C 1/28 280/634 |
| 2004/0090022 | A1 | 5/2004 | Bobbert et al. | |
| 2009/0273149 | A1 * | 11/2009 | Wilson | A63C 1/32 280/11.18 |
| 2010/0264638 | A1 | 10/2010 | Meijer | |
| 2015/0282563 | A1 * | 10/2015 | Smirman | A43B 7/14 12/146 R |

FOREIGN PATENT DOCUMENTS

| | | | | |
|---|---|---|---|---|
| EP | 1923104 | A1 | 5/2008 | |
| NL | 1013888 | C2 * | 6/2001 | A63C 1/28 |
| NL | 1024330 | C1 | 3/2005 | |
| NL | 1037732 | C * | 9/2011 | |
| WO | 9637269 | A1 | 11/1996 | |
| WO | WO-2006107200 | A2 * | 10/2006 | A63C 1/28 |
| WO | WO-2018064616 | A1 * | 4/2018 | A63C 1/28 |
| WO | WO-2018081104 | A1 * | 5/2018 | A63C 1/32 |

OTHER PUBLICATIONS

Anonymous, "sharpening/profiling | HFBoards—NHL Message Board and Forum for National Hockey League", Oct. 19, 2006), retrieved from the Internet <URL:https://hfboards.mandatory.com/threads/sharpening-profiling.302344/> [retrieved on Mar. 19, 2019] 16 pages.

First Office Action for corresponding Chinese application No. 2019800487530; dated Jul. 27, 2022 (15 pages).

* cited by examiner

CLAP SKATE

The invention relates to a clap skate comprising a blade having a rockering, a frame, typically comprising a metal tube, holding the blade in its bottomside and comprising, on its topside, a heel support for the heel portion of a skating shoe or bracket and a forefoot support connected to a front part of a skating shoe or a bracket via a pivot. The invention further relates to an undercarriage for a clap skate.

U.S. Pat. No. 6,193,243 relates to a clap skate which includes "a forefoot support which is adapted for fastening the sole portion of a skating shoe thereon. The forefoot support is pivotally connected to the front part of a skate frame about a transverse pivot pin, so as to allow said forefoot support with the skating shoe thereon to tilt about the pivot pin forwardly from a normal position, so that the skating shoe is lifted with its heel portion from the rear portion of the skate frame. The pivot pin is held between two bracket flanges extending upwardly from the front part of the skate frame. A spring mechanism tending to cause the forefoot support to return into the normal position comprises a U-shaped spring wire, the cross portion of which engages the upper face of the forefoot support and the legs of which are provided with a helically wound portion. The helically wound portions are each positioned around the pivot pin in an intermediary space between a flange and one lateral end of said forefoot support."

WO 96/37269 relates to "a frame for a sporting device for coupling to a shoe, such as a ski which is slidable or rollable by means of wheels, in particular a cross-country ski, or a skate frame for an ice-skate or roller-skate, which frame comprises: an upper sub-frame with means for coupling to a shoe to be worn by a user; a lower sub-frame which is coupled via a pivot mechanism to said upper sub-frame for pivoting in a main plane and which is provided with or adapted to be provided with a runner or wheels; and resetting spring means for urging both sub-frames toward each other."

US 2004/090022 relates to a connecting mechanism for pivotally connecting a shoe to a sporting device, such as an ice skate, a roller skate, a ski, and other similar sporting devices. In an embodiment, the connecting mechanism comprises a "connecting element 9 [that] can include a first end 9' and a second end 9". The first end 9' of the connecting element 9 can be attached, mounted, or otherwise disposed on the sporting device 6. The second end 9" of the connecting element 9 can be attached to the second end 8" of the coupling element 8 via the second pivot 3."

In clap skates, the skate frame has a forefoot support and a heel support. The forefoot support is fixed, e.g. welded, to a front portion of the frame, and comprises a pivot, typically a transverse pivot pin, inherently fixed relative to the frame. The forefoot portion of a skating shoe is or can be attached, directly or via e.g. a bracket, to the pivot. The heel support is fixed, e.g. welded, to a rear portion of the frame. The heel portion of a skating shoe is releasably attached, directly or via e.g. the bracket, to the heel support. At least one spring attached to the frame and to the skating shoe or bracket, resiliently maintains the frame and the blade urged with the heel support to the heel portion of the skating shoe or of the bracket.

During skating, near the end of a stroke, the skate opens, i.e., the heel support on the frame and the heel portion of the skating shoe or of the bracket disengage, and the foot of the skater tilts forward and away from the skate frame, while the blade maintains contact with the ice, against the action of the spring. When the skater lifts his foot, the spring pulls the frame to its normal or closed position, i.e. the heel support of the frame re-engages the heel portion of the skating shoe or of the bracket, typically sounding a "clap" (hence the name "clap skate"). Thus, the pivot connection between the frame and the skating shoe allows the foot of the skater to turn away from the skate frame while the blade maintains contact with the ice, extending the stroke and improve efficiency.

It is an object of the present invention to improve efficiency of clap skates and thus enable skaters to achieve higher speeds.

To this end, the clap skate according to the present invention is characterized in that the forefoot support provides a fixed connection to the frame, which fixed connection extends in front of the pivot and at the most 5 mm behind the pivot, e.g. 3 mm behind the pivot. In a refinement, the fixed connection extends in front of the pivot and at the most 2 mm behind the pivot, e.g. 0,5 mm behind the pivot. In a further refinement, the fixed connection extends entirely in front of the pivot, i.e. with no fixed connection behind the pivot.

With the present invention, efficiency of the clap skate and thus the speed of the skater are improved, which is especially noticeable in high performance skaters. The mechanism behind this improvement is currently believed to be as follows. During push off, the blade of a skate will bend resiliently. In blades comprising, as blades in most speed skates do, a rockering, the reaction force exerted by the ice on the blade is concentrated in a relatively small area, e.g. in an area extending 3 to 5 centimeters along the blade, which results in a slightly curved blade. During the stroke, the location of this area shifts from the rear half of the blade towards the front of the blade. When, near the end of the stroke, the center of this area is roughly at the pivot of the clap skate, just before the skate opens, the blades bends in a double wave or similar form. It was found that this double wave causes an interaction with the ice that affects efficiency, i.e. hinders the forward sliding movement on the ice. With the present invention, i.e. by providing a fixed connection of the forefoot support to the frame, which fixed connection extends in front of the pivot and at the most 5 mm behind the pivot, instead of a fixed connection that extends mostly behind the pivot, as in prior art skates, this interaction is reduced, i.e. postponed and/or its duration shortened, and efficiency improved.

In an embodiment, the forefoot support extends behind the pivot and the part that extends behind the pivot is downwardly supported and laterally decoupled. In a refinement, at least a rear portion of the forefoot support is provided with a recess, e.g. a cut-out, which decouples part of a top portion of the forefoot support from (the lower) part of a rear portion of the forefoot support.

It is preferred that a bearing, spring, e.g. an elastomeric element, or (double) hinge is located in the recess. In an embodiment, one of the parts comprises a bearing ball or roller and the other comprises a surface for the ball or roller to roll on.

Thus, despite decoupling in lateral direction, support in the downward direction is maintained.

In an embodiment, the forefoot support and the heel support are part of or interconnected by a bridge. The bridge can be connected to the frame, e.g. halfway between the forefoot and heel supports. However, it is preferred that, if a bridge is present, in a region extending at least 5 centimeters, preferably at least 10 centimeters behind the pivot, there are no connections between the bridge and the frame. In an embodiment, the bridge in only connected to the frame by the forefoot and heel supports.

The invention further relates to an undercarriage for a clap skate comprising a blade having a rockering, a frame, typically comprising a metal tube, holding the blade in its bottomside and comprising, on its topside, a heel support for the heel portion of a skating shoe or bracket and a forefoot support connected to a front part of a skating shoe or bracket via a pivot, characterized in that the forefoot support provides a fixed connection to the frame, which connection extends in front of the pivot and at the most 5 mm, preferably at the most 2 mm, behind the pivot. In an embodiment, the fixed connection extends entirely in front of the pivot, i.e. with no fixed connection behind the pivot.

The embodiments described above in relation to the clap skate according to the present invention apply also to the present undercarriage.

Within the framework of the present invention the terms "front" and "rear" refer to the location of the parts of the skate seen in the usual skating direction. The terms "top" and "bottom" refer to the location of the parts of the skate when it is located upright and with its blade on the ice. The rockering typically has a radius in a range from 5 to 30 meters, more specifically in a range from 5 to 15 meters for short track speed skating and 21 to 27 meters for long track speed skating. It is preferred that the center of the rockering, i.e. the center of the imaginary circle defining the rockering, is positioned above and between the heel support and the forefoot support.

Figure 2:
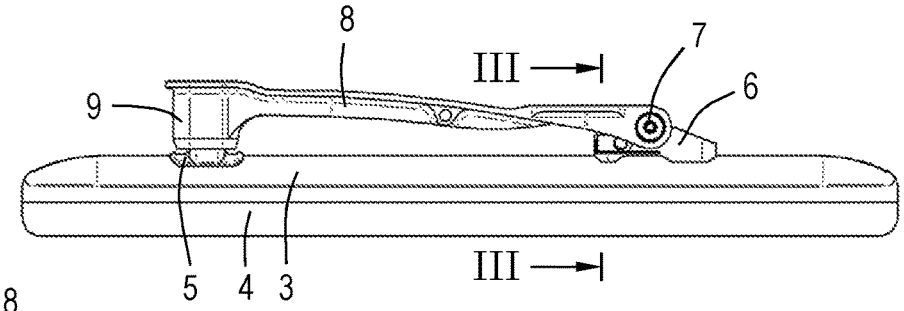
FIG. 2 is a right side view of the undercarriage of the clap skate shown in FIG. 1.
Figure 4:
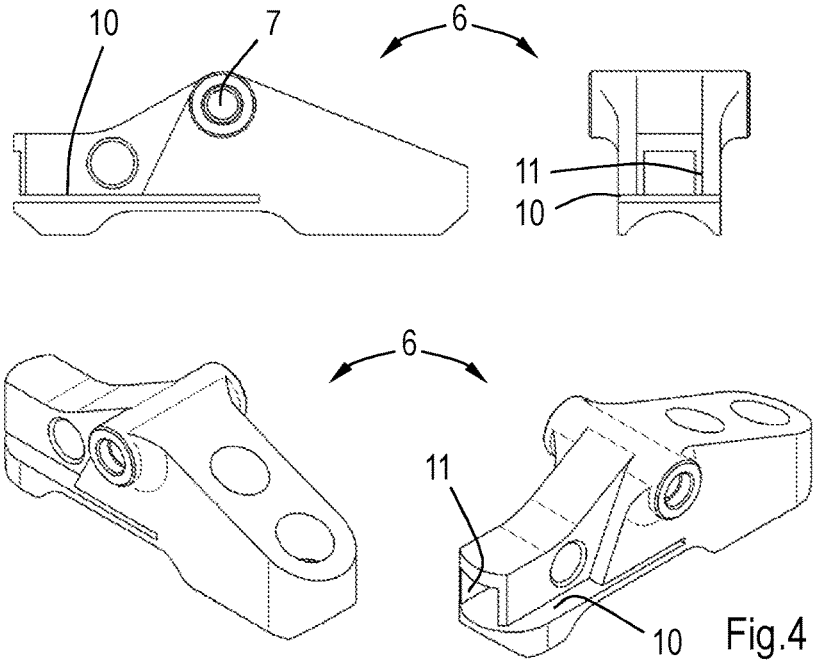

FIG. 4 includes a right side view, rear, and two perspective views of a the forefoot support used in the undercarriage shown in FIG. 2.

It is noted that the Figures are schematic in nature and that details, which are not necessary for understanding the present invention, may have been omitted.

Figure 1:
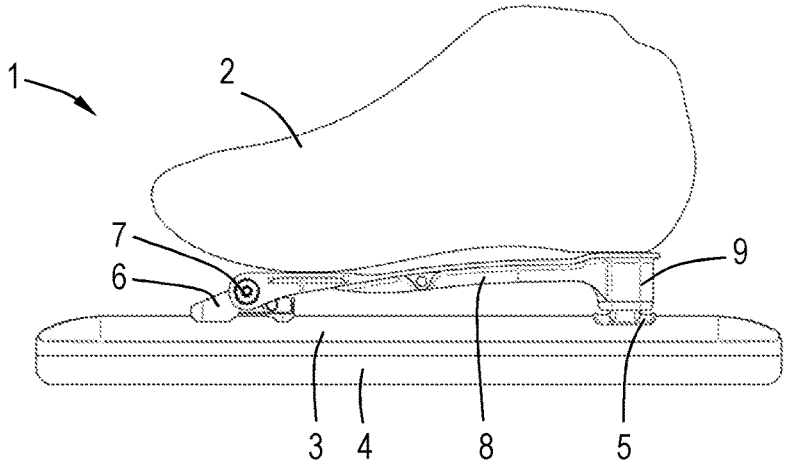
FIG. 1 is a left side view of a clap skate according to the present invention.

FIG. 1 shows a clap skate 1, comprising a skating shoe 2, a tubular frame 3, and a blade 4, also known as runner or steel, held, e.g. welded, in bottomside of the frame. A heel support 5 and a forefoot support 6 are fixed, e.g. welded, to the frame, near its rear and front ends, respectively. The forefoot support 6 comprises a pivot, typically a transverse pivot pin 7, to which a bracket 8 is attached. Thus, the bracket and skating shoe are pivotally attached to the frame and blade.

The skating shoe 2 is, in a manner known in itself, adjustably mounted on the bracket 8. The heel portion 9 of the bracket releasably engages the heel support 5 on the frame 3. Further, at least one spring (not shown) is attached, on the one hand, to the frame 3 and, on the other, to the bracket 8 to bias the heel support 5 in engagement with the heel portion 9 of the bracket 8.

Figure 3:
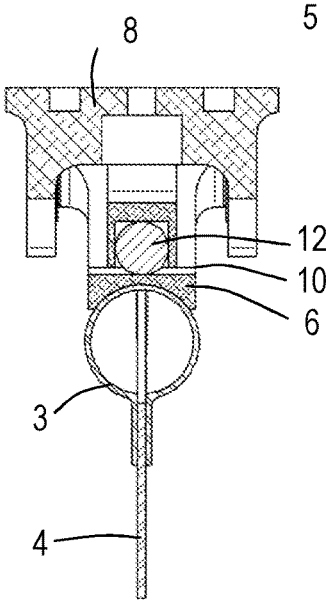
FIG. 3 is a rear view of a cross-section of the undercarriage shown in FIG. 2.

The forefoot support 6 is provided, in its rear section, with a cut-out 10 (best seen in FIG. 4) which decouples the rear of top and bottom portions of the support 6 up to and slightly beyond the pivot 7. The rear end of the cut-out is provided with an additional recess 11, which accommodates a bearing ball or, in this example, a roller 12 (FIG. 3), with its rotational axis extending parallel to the blade 4.

Thus, the fixed part of the connection to the frame extends entirely in front of the pivot and the remainder of the forefoot support is laterally decoupled.

The invention is not restricted to the embodiments described above and can be varied in numerous ways within the scope of the claims.

The invention claimed is:

1. Clap skate comprising a blade having a rockering, and a frame, holding the blade in its bottomside and comprising, on its topside, a heel support for the heel portion of a skating shoe or a bracket and a forefoot support connected to a front part of a skating shoe or bracket via a pivot, wherein the forefoot support provides a fixed connection to the frame, which fixed connection extends entirely in front of the pivot.

2. The clap skate according to claim 1, wherein a part of the forefoot support extends behind the pivot and wherein the part of the forefoot support that extends behind the pivot comprises a lateral decoupling.

3. The clap skate according to claim 2, wherein at least a rear portion of the forefoot support is provided with a recess, which decouples part of a top portion of the forefoot support from part of a rear portion of the forefoot support.

4. The clap skate according to claim 3, wherein a bearing, spring, or hinge is located in the recess.

5. The clap skate according to claim 4, wherein one of the parts of the top and rear portion of the forefoot support comprises a bearing ball or roller and the other of the parts of the top and rear portion of the forefoot support comprises a surface for the ball or roller to roll on.

6. The clap skate according to claim 1, wherein the center of the rockering is positioned above and between the heel support and the forefoot support.

7. The clap skate according to claim 1, wherein the rockering has a radius in a range from 5 to 30 meters.

8. The clap skate according to claim 1, wherein the frame is tubular and/or made from aluminium.

9. Undercarriage for a clap skate comprising a blade having a rockering, and a frame holding the blade in its bottomside and comprising, on its topside, a heel support for the heel portion of a skating shoe or a bracket and a forefoot support connected to a front part of a skating shoe or bracket via a pivot, and wherein the forefoot support provides a fixed connection to the frame, which connection extends entirely in front of the pivot.

10. The undercarriage according to claim 9, wherein a part of the forefoot support extends behind the pivot and wherein the part of the forefoot support that extends behind the pivot comprises a lateral decoupling.

11. The undercarriage according to claim 10, wherein at least a rear portion of the forefoot support is provided with a recess, which decouples part of a top portion of the forefoot support from part of a rear portion of the forefoot support.

12. The clap skate according to claim 1, wherein a part of the forefoot support extends behind the pivot and wherein the part of the forefoot support that extends behind the pivot comprises a lateral decoupling.

13. The clap skate according to claim 1, wherein a part of the forefoot support extends behind the pivot and wherein the part of the forefoot support that extends behind the pivot comprises a lateral decoupling.

14. The clap skate according to claim 1, wherein the rockering has a radius in a range from 21 to 27 meters.

15. The undercarriage according to claim 9, wherein a part of the forefoot support extends behind the pivot and wherein the part of the forefoot support that extends behind the pivot comprises a lateral decoupling.

16. The undercarriage according to claim 9, wherein a part of the forefoot support extends behind the pivot and wherein the part of the forefoot support that extends behind the pivot comprises a lateral decoupling.

* * * * *